US010765584B2

(12) United States Patent
Shieh

(10) Patent No.: US 10,765,584 B2
(45) Date of Patent: Sep. 8, 2020

(54) FOLDABLE FRAME CONSTRUCTION FOR MOBILITY AIDS

(71) Applicant: Shanq-Ching Shieh, Changhua Hsien (TW)

(72) Inventor: Shanq-Ching Shieh, Changhua Hsien (TW)

( * ) Notice: Subject to any disclaimer, the term of this patent is extended or adjusted under 35 U.S.C. 154(b) by 23 days.

(21) Appl. No.: 16/238,607

(22) Filed: Jan. 3, 2019

(65) Prior Publication Data

US 2020/0214924 A1 Jul. 9, 2020

(51) Int. Cl.

*A47C 1/026* (2006.01)
*A61G 5/08* (2006.01)
*A61H 3/00* (2006.01)

(52) U.S. Cl.

CPC ..... *A61H 3/00* (2013.01); *A47C 1/026* (2013.01); *A61H 2201/0161* (2013.01)

(58) Field of Classification Search

CPC .... A61H 2201/0161; A61H 2201/1633; A47C 1/022; A47C 1/026; A47C 1/0246; A47C 1/027; A47C 4/04; A47C 4/10; A47C 4/20; A47C 4/286; A47C 4/34; A47C 4/00; A47C 4/28; A47C 5/10; A47D 1/02; A61G 1/013; A61G 1/017; A61G 7/0038; A61G 7/1074; A61G 7/7076; A61G 5/0833; A61G 5/085; A61G 5/0866; Y10T 403/32336; Y10T 16/546; Y10T 16/5404

See application file for complete search history.

(56) References Cited

U.S. PATENT DOCUMENTS 2,812,961 A * 11/1957 Brown ..... A61F 2/582 403/93
3,232,136 A * 2/1966 Bahmuller ..... B60N 2/2352 74/533
3,352,580 A * 11/1967 Helene Kurz ..... A47C 20/045 403/93
3,740,791 A * 6/1973 Bulin ..... E05C 17/32 16/346
3,779,655 A * 12/1973 Toyota ..... A47C 1/026 403/93
3,918,822 A * 11/1975 Rauschenberger .... A47C 1/026 403/62
4,354,710 A * 10/1982 Rauschenberger .... A47C 1/026 16/343

(Continued)

*Primary Examiner* — Kyle J. Walraed-Sullian
(74) *Attorney, Agent, or Firm* — Alan D. Kamrath; Karin L. Williams; Mayer & Williams PC

(57) ABSTRACT

A foldable frame construction for mobility aids has a mounting frame, a pivotal arm, and an operating element. The mounting frame has a fixed end, a limiting end, a limiting hole formed through the mounting frame adjacent to the limiting end, and a through hole formed through the mounting frame between the fixed end and the limiting hole. The pivotal arm is rotatably connected to the mounting frame and has a positioning hole formed through the pivotal arm and selectively aligning with the through hole. The operating element is connected to the pivotal arm and the mounting frame to limit a position of the pivotal arm relative to the mounting frame, and has a fixing ring base securely connected to the pivotal arm around the positioning hole, an engaging bolt movably mounted in the fixing ring base, and a pull button connected to the engaging bolt.

11 Claims, 10 Drawing Sheets

(56) References Cited

U.S. PATENT DOCUMENTS 4,666,328 A * 5/1987 Ryu ..... E06C 1/32 16/329
4,684,278 A * 8/1987 Rauschenberger ..... A47C 4/20 16/365
5,169,257 A * 12/1992 Liou ..... A47C 20/045 16/333
5,369,843 A * 12/1994 Yu ..... E05B 65/5292 16/343
5,722,730 A * 3/1998 McKernan ..... B60N 2/433 16/328
6,186,595 B1 * 2/2001 Ward ..... B60N 2/20 297/376
6,343,805 B1 * 2/2002 Roy ..... A61G 5/08 280/250.1
6,711,780 B2 * 3/2004 Lee ..... E06C 1/32 16/326
6,991,248 B2 * 1/2006 Valdez ..... B62B 7/062 280/647
7,273,249 B1 * 9/2007 Tseng ..... A47C 4/10 297/16.1
7,632,035 B2 * 12/2009 Cheng ..... B62B 7/062 403/98
7,984,531 B2 * 7/2011 Moore ..... A61F 5/0125 16/326
8,550,559 B2 * 10/2013 Sollars ..... B60N 2/2236 297/362.11
8,715,367 B1 * 5/2014 Pansiera ..... A61F 2/68 623/43
9,149,120 B2 * 10/2015 Crofts ..... A47C 1/026
9,193,373 B2 * 11/2015 Fjelland ..... B62B 7/08
9,399,421 B2 * 7/2016 Lu ..... A47C 7/38
10,258,533 B1 * 4/2019 Chu ..... A45B 9/04
2004/0104559 A1 * 6/2004 Chen ..... A61H 3/04 280/642
2005/0046260 A1 * 3/2005 Yamashita ..... A47C 1/026 297/361.1
2006/0061066 A1 * 3/2006 Tan ..... B62B 7/062 280/642
2006/0157953 A1 * 7/2006 Goertzen ..... A61G 5/06 280/250.1
2006/0175803 A1 * 8/2006 Santoski ..... B62B 7/062 280/642
2008/0258436 A1 * 10/2008 Storm ..... B62B 7/062 280/642
2009/0288270 A1 * 11/2009 Yamashita ..... A47C 1/026 16/239
2010/0181124 A1 * 7/2010 Wang ..... A61G 5/045 180/65.1
2010/0200030 A1 * 8/2010 Yefimov ..... A61H 3/02 135/66
2010/0314914 A1 * 12/2010 Mazzola ..... A47C 3/34 297/16.2
2011/0042994 A1 * 2/2011 Saito ..... B60N 2/2245 296/65.13
2011/0224585 A1 * 9/2011 Hall ..... A61H 1/024 601/34
2011/0266840 A1 * 11/2011 Wu ..... A47C 4/04 297/41
2011/0278808 A1 * 11/2011 Kline ..... A47C 7/008 280/43
2013/0113187 A1 * 5/2013 Willis ..... A61H 3/04 280/649
2013/0168931 A1 * 7/2013 Baraitaru ..... A61H 3/04 280/30
2014/0137912 A1 * 5/2014 Kline ..... A47C 7/008 135/67
2015/0040351 A1 * 2/2015 Muir ..... E05D 11/06 16/343
2015/0130246 A1 * 5/2015 Hashida ..... A47C 1/027 297/376
2015/0209205 A1 * 7/2015 Ransenberg ..... B62K 15/008 280/641
2015/0313364 A1 * 11/2015 Miller ..... A47C 4/04 297/19
2015/0335110 A1 * 11/2015 Holmes ..... A45B 5/00 135/66
2015/0342804 A1 * 12/2015 Ling ..... A61G 1/0237 280/640
2016/0058637 A1 * 3/2016 Horacek ..... A61G 5/08 280/649
2017/0119159 A1 * 5/2017 Mailloux ..... A47C 4/04
2017/0209319 A1 * 7/2017 Fawcett ..... A61H 3/04
2017/0296407 A1 * 10/2017 Kuschall ..... A61G 5/08
2019/0239651 A1 * 8/2019 Lin ..... A47C 7/543
2020/0078257 A1 * 3/2020 Miller ..... A61H 3/04

* cited by examiner

FOLDABLE FRAME CONSTRUCTION FOR MOBILITY AIDS

BACKGROUND OF THE INVENTION

1. Field of the Invention

The present invention relates to a foldable frame construction, and more particularly to a foldable frame construction for mobility aids that may be operated conveniently, may save space, and may provide high practicality.

2. Description of Related Art

With the advancement of medicine and the development of science and technology, the life expectancy of human beings has gradually prolonged and the proportion of senior population has gradually increased. Therefore, mobility aids currently available to the elderly are also increasing. Among them, conventional mobility aids include walkers, wheelchairs, and ladder climb assist systems, etc. Although the conventional mobility aids may provide certain auxiliary effects for the elderly, most of the conventional mobility aids, in order to provide sufficient structural strength, are fixed and unfoldable in structural design and configuration.

Although the conventional mobility aids with fixed configuration can provide sufficient structural strength, the fixed structures of the conventional mobility aids cannot provide a folding effect to the conventional mobility aids. Therefore, the conventional mobility aids cannot be adjusted in size, may occupy a certain space and cannot travel or be transported in a narrow space, and this may increase the storage space required by the user, is inconvenient in use and may limit the practicality of the conventional mobility aids.

To overcome the shortcomings, the present invention tends to provide a foldable frame construction to mitigate or obviate the aforementioned problems.

SUMMARY OF THE INVENTION

The main objective of the present invention is to provide a foldable frame construction for mobility aids that may be operated conveniently, may save space, and may provide high practicality.

The foldable frame construction for mobility aids in accordance with the present invention has a mounting frame, a pivotal arm, and an operating element. The mounting frame has a fixed end, a limiting end, a limiting hole formed through the mounting frame adjacent to the limiting end, and a through hole formed through the mounting frame between the fixed end and the limiting hole. The pivotal arm is rotatably connected to the mounting frame and has a pivotal end, a pressing end, and a positioning hole formed through the pivotal arm and selectively aligning with the through hole. The operating element is connected to the pivotal arm and the mounting frame to limit a position of the pivotal arm relative to the mounting frame, and has a fixing ring base securely connected to the pivotal arm around the positioning hole, an engaging bolt movably mounted in the fixing ring base, and a pull button connected to the engaging bolt.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
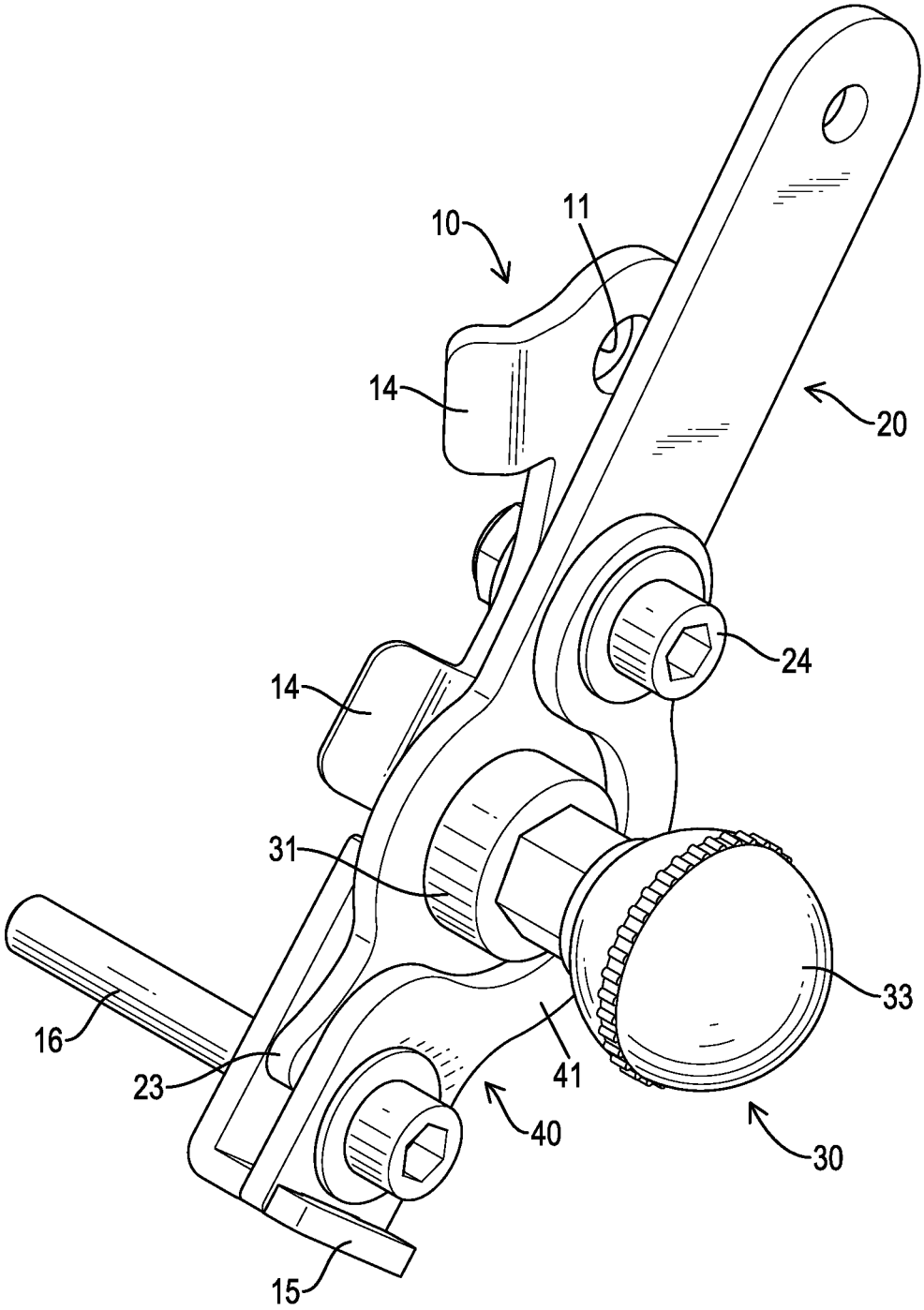
FIG. 1 is a perspective view of a first embodiment of a foldable frame construction for mobility aids in accordance with the present invention.
Figure 2:
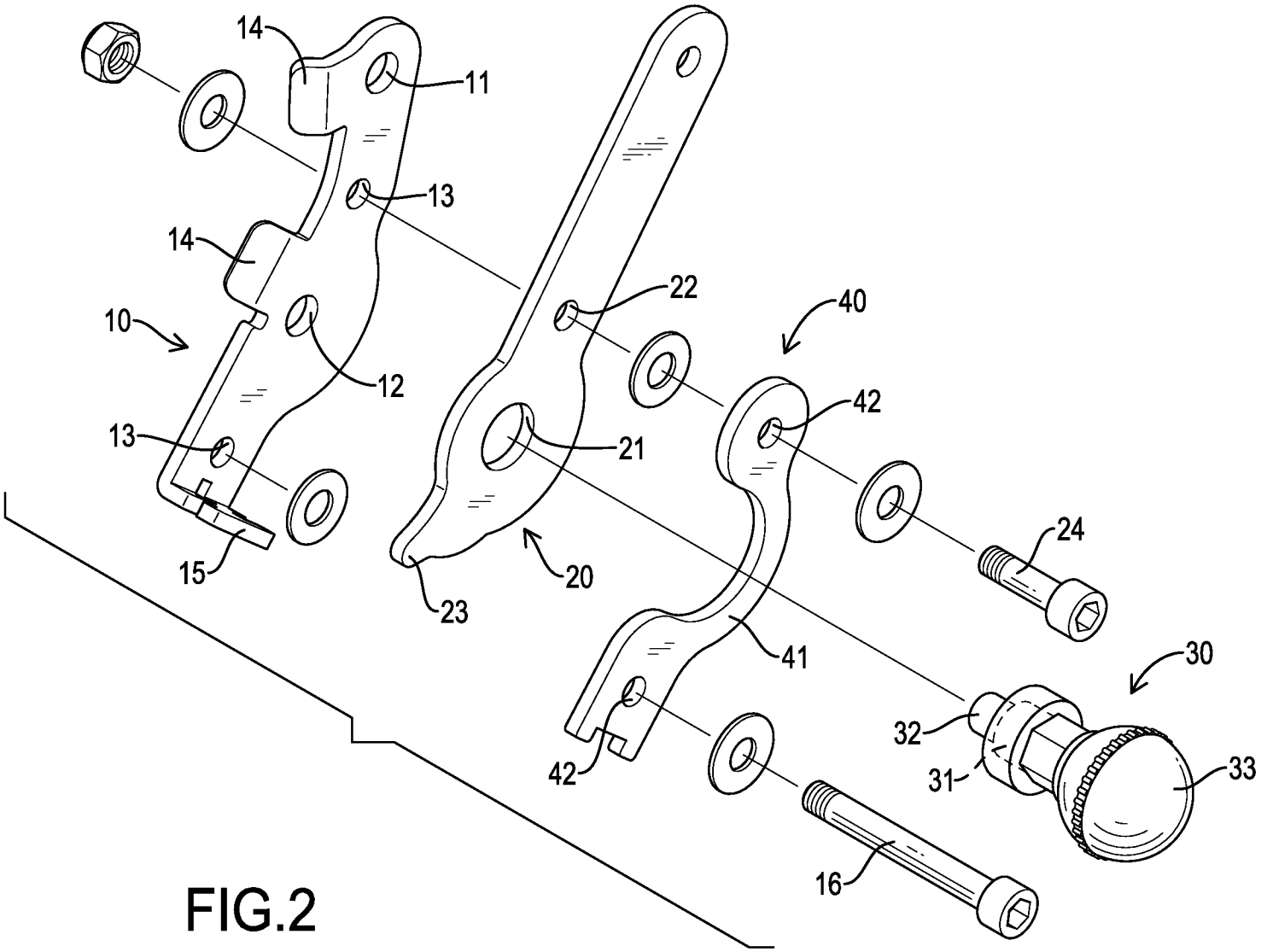
FIG. 2 is an exploded perspective view of the foldable frame construction in FIG. 1.
Figure 3:
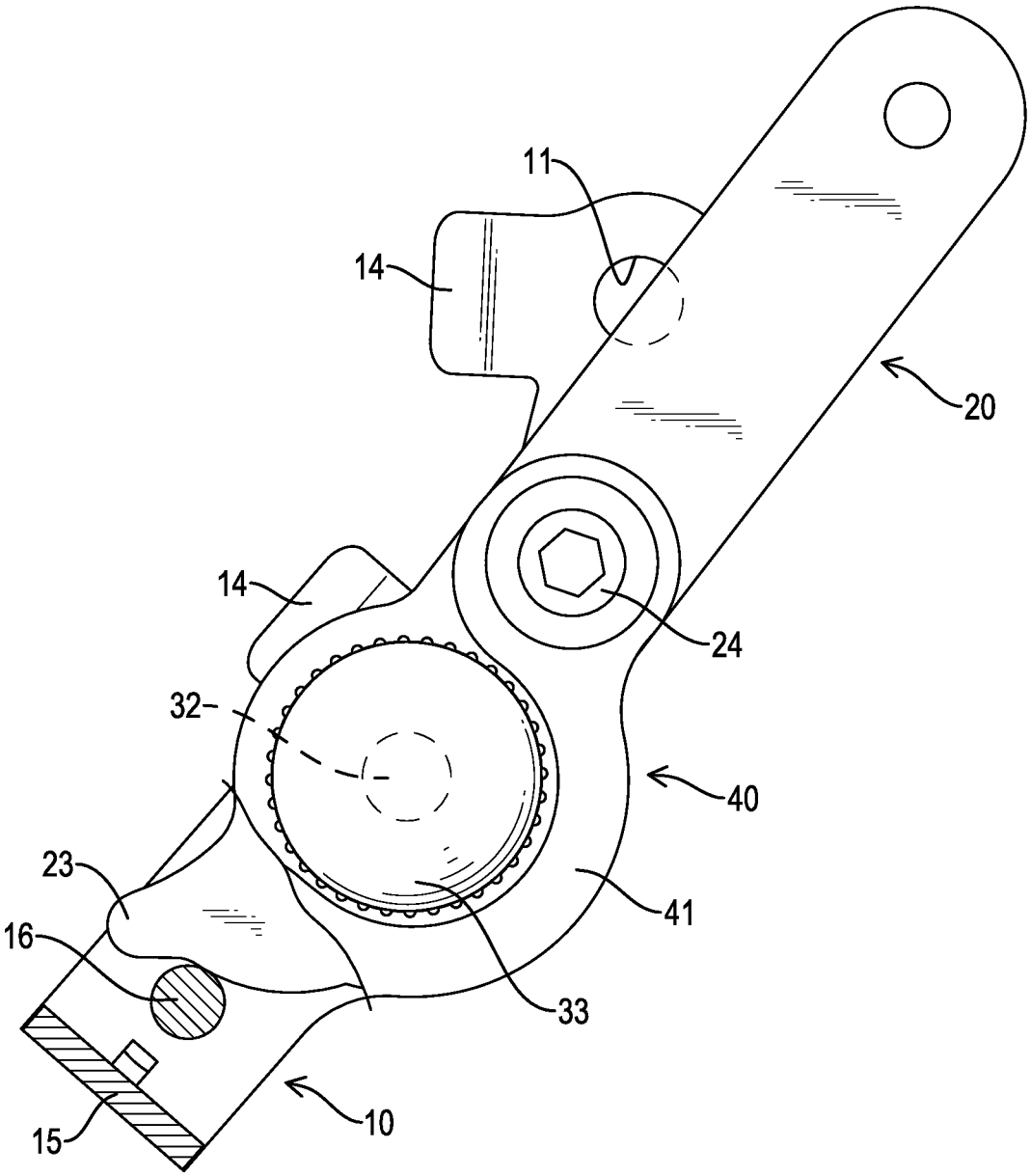
FIG. 3 is a side view in partial section of the foldable frame construction in FIG. 1.

With reference to FIGS. 1 to 3, a first embodiment of a foldable frame construction for mobility aids in accordance with the present invention has a mounting frame 10, a pivotal arm 20, an operating element 30, and a reinforcing rib 40.

Figure 6:
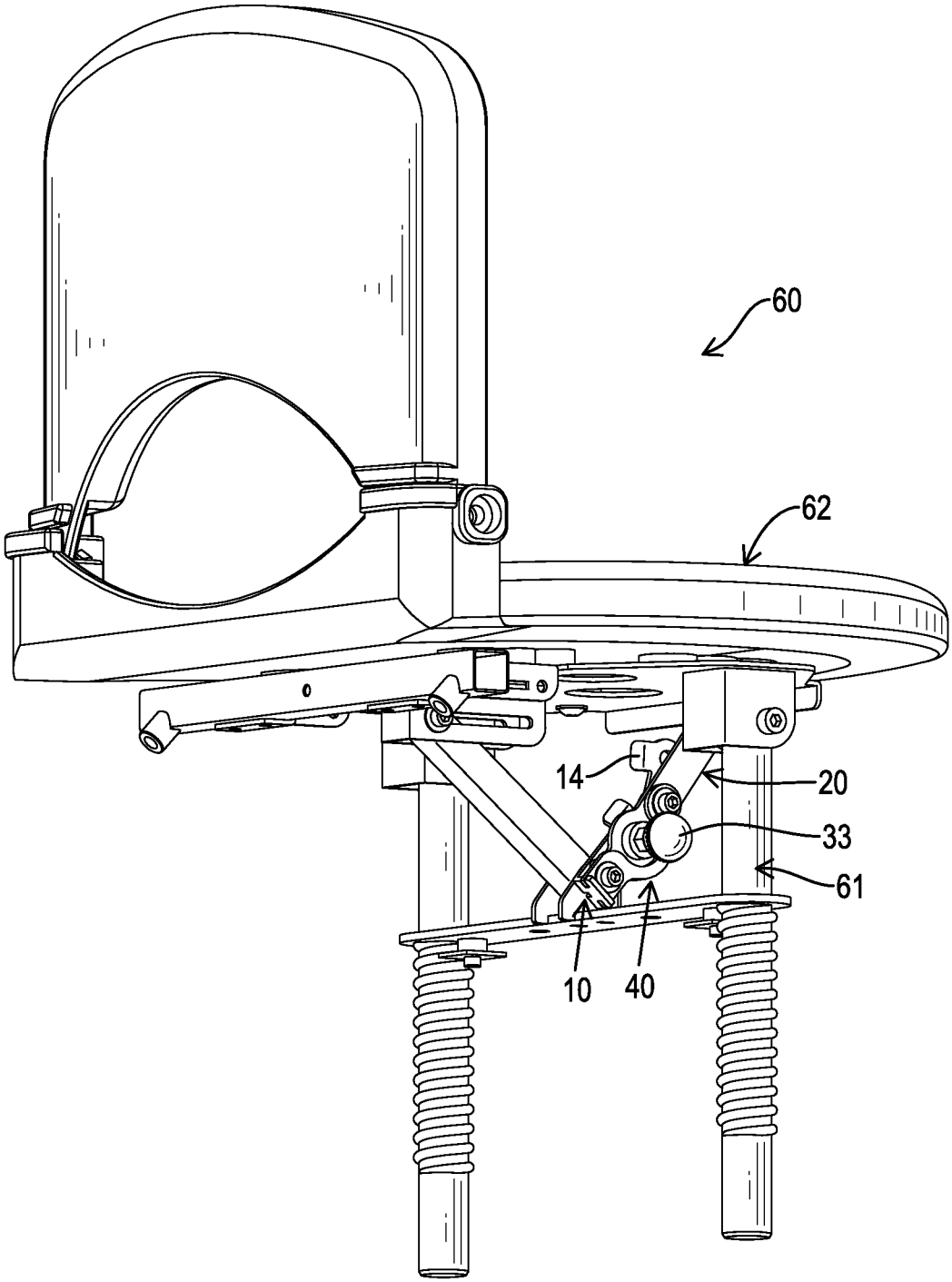
FIG. 6 is an operational perspective view of the foldable frame construction in FIG. 1, mounted with an assistive device.

The mounting frame 10 has a fixed end, a limiting end, a side edge, a connecting tab 15, a limiting hole 11, a through hole 12, two pivot holes 13, a pivot shaft 16, and at least one guiding slice 14. The limiting end of the mounting frame 10 is opposite to the fixing end of the mounting frame 10. With further reference to FIG. 6, the fixed end of the mounting frame 10 is securely connected to a chair frame 61 of an assistive device 60. The connecting tab 15 is formed on and protrudes from the fixed end of the mounting frame 10 to connect the mounting frame 10 with the chair frame 61 of the assistive device 60. The limiting end of the mounting frame 10 extends outwardly out of the assistive device 60.

The limiting hole 11 is formed through the mounting frame 10 adjacent to the limiting end of the mounting frame 10. The through hole 12 is formed through the mounting frame 10 between the fixed end and the limiting hole 11 of the mounting frame 10. The two pivot holes 13 are formed through the mounting frame 10 at a spaced interval, and the through hole 12 is disposed between the two pivot holes 13. The pivot shaft 16 is connected to one of the two pivot holes 13 that is disposed between the through hole 12 and the fixed end of the mounting frame 10. The at least one guiding slice 14 is aslant formed on and protrudes from the side edge of the mounting frame 10 adjacent to the limiting hole 11 or the through hole 12. Furthermore, the mounting frame 10 has two guiding slices 14, and one of the two guiding slices 14 is disposed adjacent to the limiting hole 11, and the other one of the two guiding slices 14 is disposed adjacent to the through hole 12.

The pivotal arm 20 is rotatably connected to the mounting frame 10, and has a pivotal end, a pressing end, a flange 23, a positioning hole 21, a pivotal hole 22, and a pivotal rod 24. With reference to FIG. 6, the pivotal end of the pivotal arm 20 is disposed away from the fixed end of the mounting frame 10, and is pivotally connected to a seat 62 of the assistive device 60. The pressing end of the pivotal arm 20 is opposite to the pivotal end of the pivotal arm 20 and selectively abuts against the fixed end of the mounting frame 10 to limit the pivoting of the pivotal arm 20 relative to the mounting frame 10.

The flange 23 is formed on and protrudes from the pressing end of the pivotal arm 20 and selectively abuts against the pivot shaft 16 of the mounting frame 10. The positioning hole 21 is formed through the pivotal arm 20 and selectively aligns with the through hole 12 of the mounting frame 10. The pivotal hole 22 is formed through the pivotal arm 20 adjacent to the positioning hole 21, and aligns with the pivot hole 13 of the mounting frame 10 that is disposed between the limiting hole 11 and the through hole 12. The pivotal rod 24 is connected to the pivotal hole 22 and the corresponding pivot hole 13 to enable the pivotal arm 20 to pivot relative to the mounting frame 10.

The operating element 30 is connected to the pivotal arm 20 and the mounting frame 10 to limit a position of the pivotal arm 20 relative to the mounting frame 10, and has a fixing ring base 31, an engaging bolt 32, and a pull button 33. The fixing ring base 31 is securely connected to the pivotal arm 20 around the positioning hole 21. The engaging bolt 32 is movably mounted in the fixing ring base 31 and has an inserting end and a connecting end. The inserting end of the engaging bolt 32 extends into the through hole 12 via the positioning hole 21 to limit the position of the pivotal arm 20 relative to the mounting frame 10. The connecting end of the engaging bolt 32 extends out of the fixing ring base 31 and is opposite to the mounting frame 10.

The pull button 33 is connected to the connecting end of the engaging bolt 32 to enable the engaging bolt 32 to move with the pull button 33 relative to the through hole 12, the positioning hole 21, and the fixing ring base 31. In addition, with reference to FIG. 4, when the inserting end of the engaging bolt 32 is separated from the through hole 12 by the pull button 33, the inserting end of the engaging bolt 32 abuts against the at least one guiding slice 14 during the rotation of the pivotal arm 20 relative to the mounting frame 10. Furthermore, with reference to FIG. 5, when the positioning hole 21 aligns with the limiting hole 11, the inserting end of the engaging bolt 32 is inserted into the limiting hole 11 via the positioning hole 21 to hold the pivotal arm 20 with the mounting frame 10.

Additionally, when the pull button 33 is released by a user, an elastic element is mounted in the fixing ring base 31 and can provide a flexible force to restore the engaging bolt 32 back to the original position. The elastic element and the return mechanism are conventional and the features and the structures of the elastic element and the return mechanism are not described in detail.

The reinforcing rib 40 is connected to the mounting frame 10 and the pivotal arm 20, and has a connecting end, a linking end, a curved segment 41, and two communicating holes 42. The connecting end of the reinforcing rib 40 is connected to the fixed end of the mounting frame 10 to hold the pivotal arm 20 between the mounting frame 10 and the reinforcing rib 40. The linking end of the reinforcing rib 40 is opposite to the connecting end of the reinforcing rib 40, and is pivotally connected to the pivotal arm 20 and the mounting frame 10. The curved segment 41 is formed on the reinforcing rib 40 between the connecting end and the linking end of the reinforcing rib 40 and surrounds the fixing ring base 31.

The two communicating holes 42 are formed through the reinforcing rib 40 respectively at the connecting end and the linking end of the reinforcing rib 40, and the communicating hole 42 that is disposed at the connecting end of the reinforcing rib 40 aligns with the pivot hole 13 that is disposed adjacent to the fixed end of the mounting frame 10. The pivot shaft 16 extends through the communicating hole 42 that is disposed at the connecting end of the reinforcing rib 40, and is connected to the corresponding pivot hole 13 to connect the reinforcing rib 40 with the mounting frame 10. The communicating hole 42 that is disposed at the linking end of the reinforcing rib 40 aligns with the pivotal hole 22 of the pivotal arm 20 and the pivot hole 13 of the mounting frame 10 that is disposed adjacent to the limiting hole 11. Then, the pivotal rod 24 is connected to the reinforcing rib 40, the pivotal arm 20, and the mounting frame 10 via the corresponding communicating hole 42, the pivotal hole 22, and the corresponding pivot hole 13.

Figure 4:
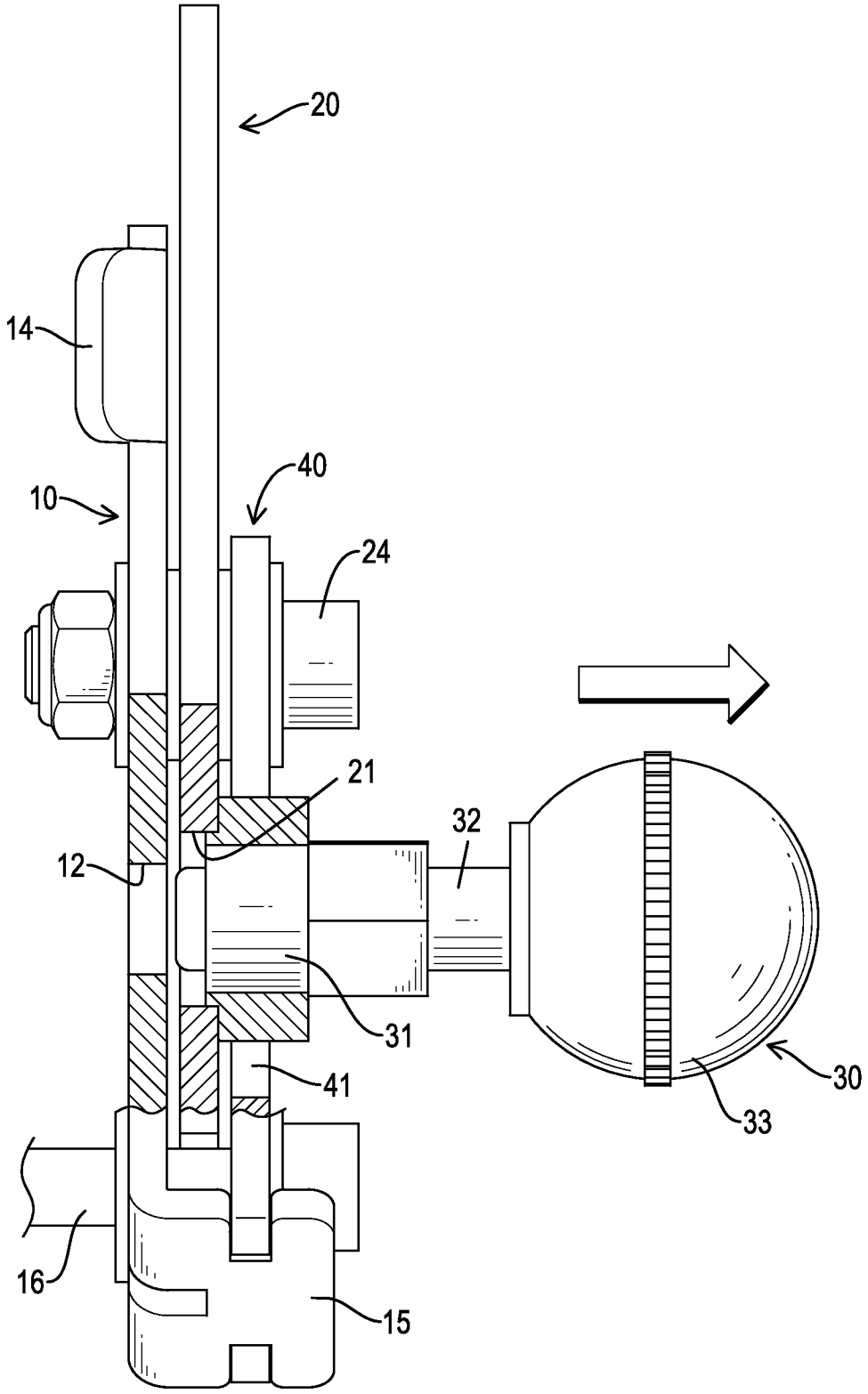
FIG. 4 is an operational side view in partial section of the foldable frame construction in FIG. 1.
Figure 5:
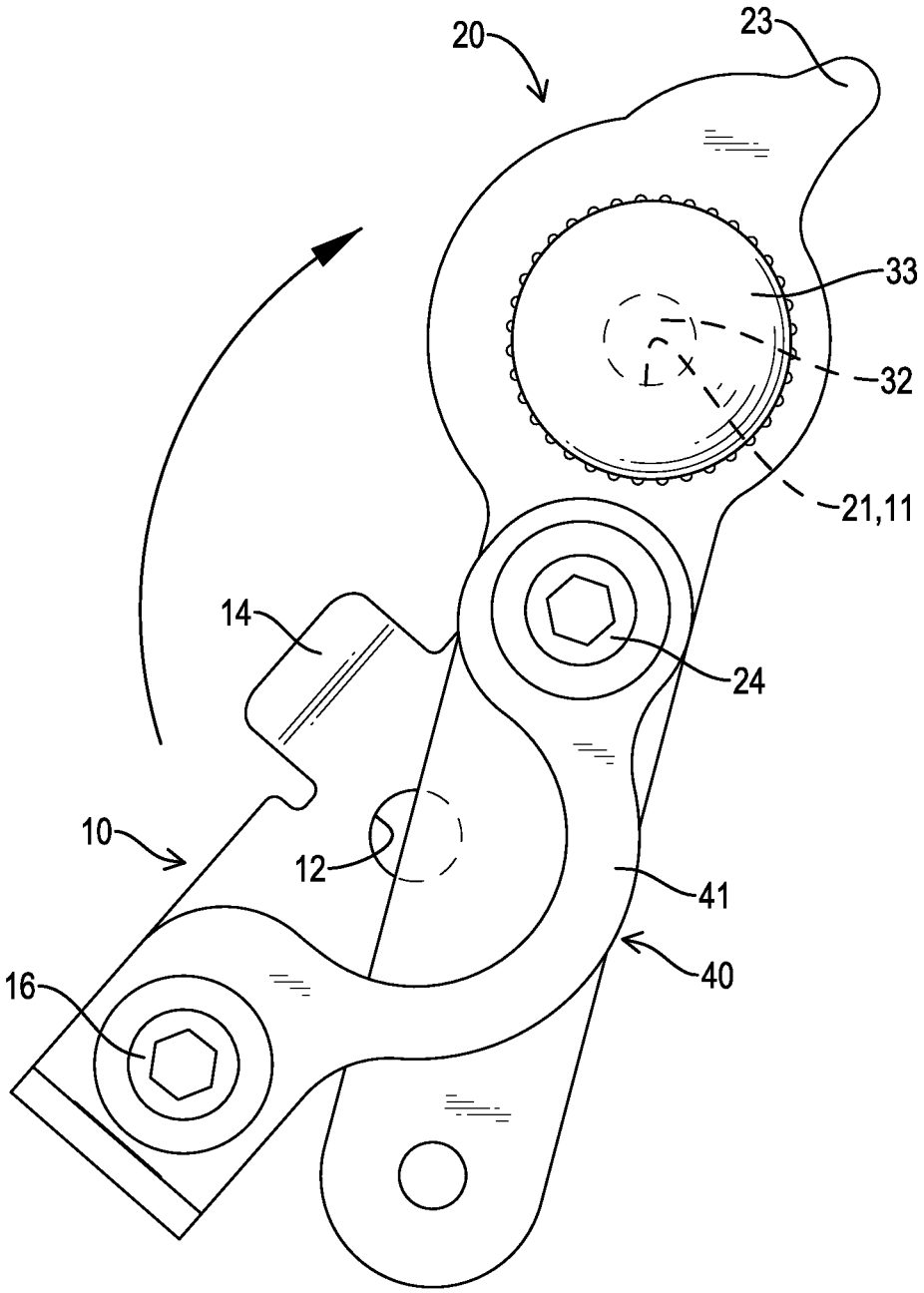
FIG. 5 is another operational side view of the foldable frame construction in FIG. 1.

With reference to FIGS. 4 and 5, when the first embodiment of the foldable frame construction for mobility aids is in use, the pull button 33 is pulled to move away from the reinforcing rib 40, and the engaging bolt 32 is moved with the pull button 33 relative to the mounting frame 10 to separate from the through hole 12. Then, the pivotal arm 20 can be pivoted relative to the mounting frame 10, and the pivotal arm 20 is pivoted relative to the mounting frame 10 with the pivotal rod 24 as a fulcrum, so that the flange 23 is separated from the pivot shaft 16 and drives the engaging bolt 32 to move along and abut against the two guiding slices 14 toward the limiting hole 11 of the mounting frame 10. The two guiding slices 14 may provide a guiding effect to the engaging bolt 32.

When the engaging bolt 32 moves into the limiting hole 11 by the guiding effect of the two guiding slices 14, the pivotal arm 20 cannot be pivoted relative to the mounting frame 10, and the first embodiment of the foldable frame construction is set under a folded condition. Additionally, when a user wants to unfold the first embodiment of the foldable frame construction, the pull button 33 is pulled to enable the inserting end of the engaging bolt 32 to separate from the limiting hole 11, and this enables the pivotal arm 20 to pivot relative to the mounting frame 10 to move the engaging bolt 32 toward the through hole 12. Then, the first embodiment of the foldable frame construction can be operated under an unfolded condition conveniently.

Figure 7:
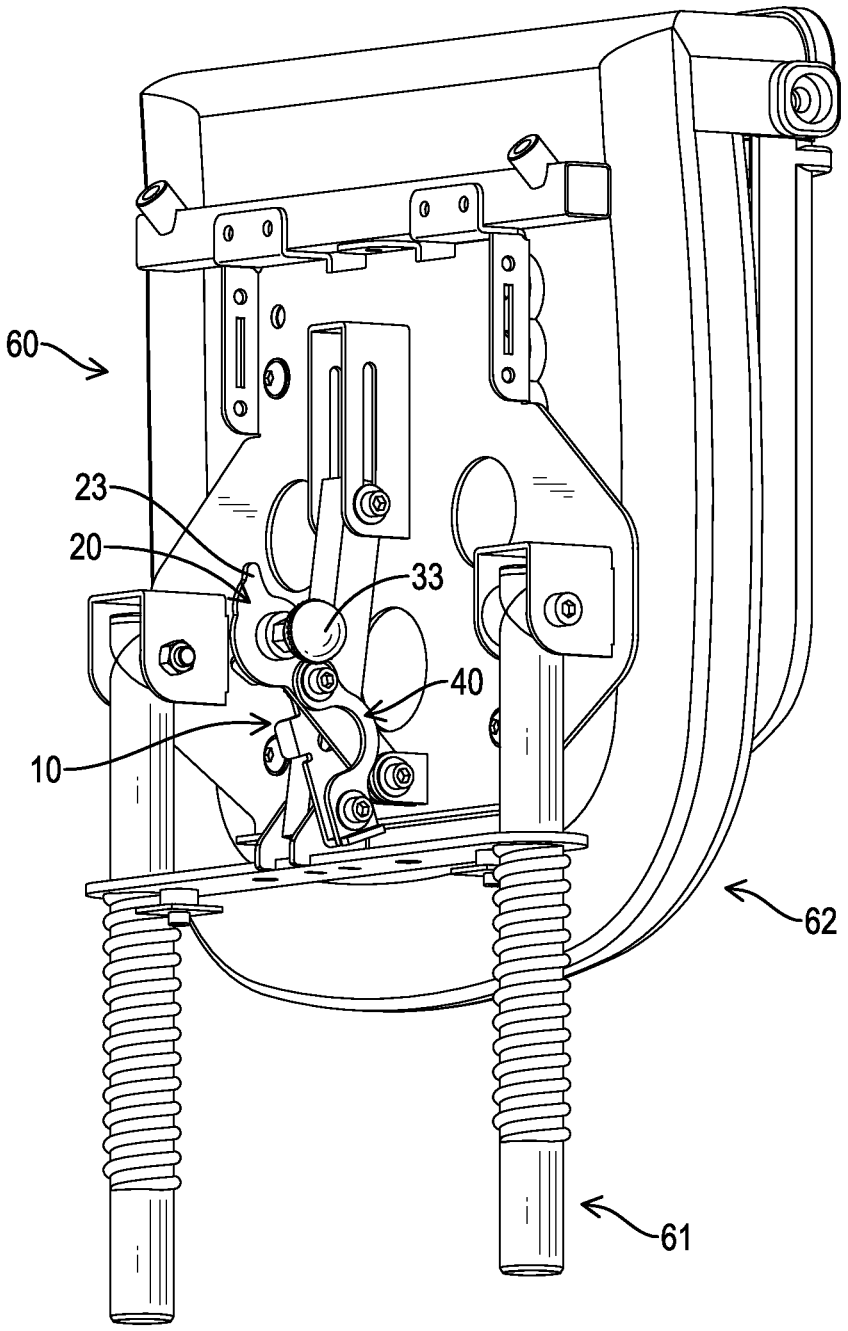
FIG. 7 is an operational perspective view of the foldable frame construction in FIG. 6 under a folded condition.

With reference to FIGS. 6 and 7, the first embodiment of the foldable frame construction can be assembled on an assistive device 60 between a chair frame 61 and a seat 62. The mounting frame 10 is connected to the chair frame 61, and the pivotal arm 20 is connected to the seat 62, and the seat 62 can be pivoted relative to the chair frame 61 by the pivotal arm 20 pivoting relative to the mounting frame 10. Then, the assistive device 60 can be folded by the first embodiment of the foldable frame construction conveniently to save space for placing the assistive device 60. Furthermore, the assistive device 60 can move or be transported in a small space under the folded condition, and this may provide high practicality of the assistive device 60.

Figure 8:
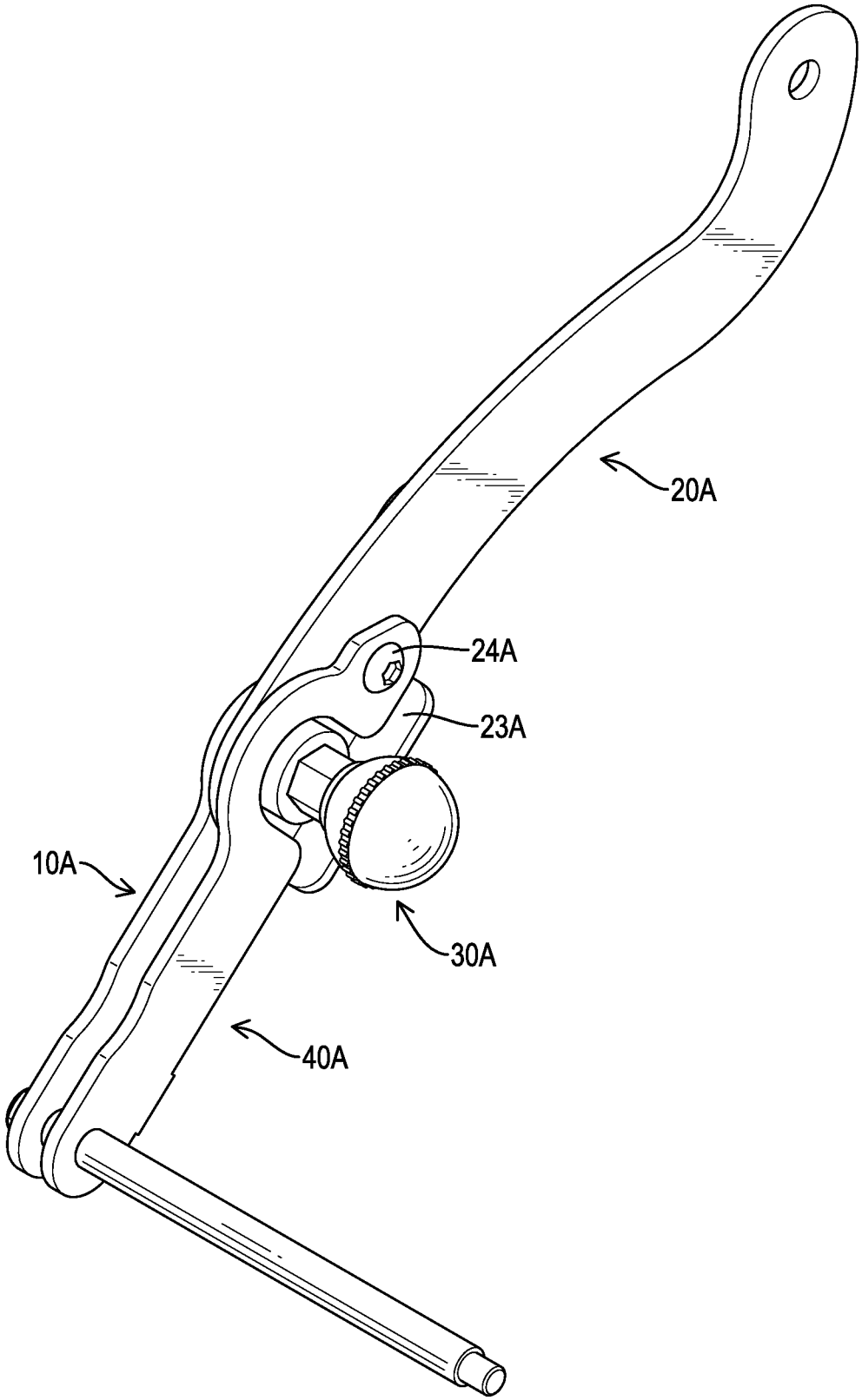
FIG. 8 is a perspective view of a second embodiment of a foldable frame construction for mobility aids in accordance with the present invention.
Figure 9:
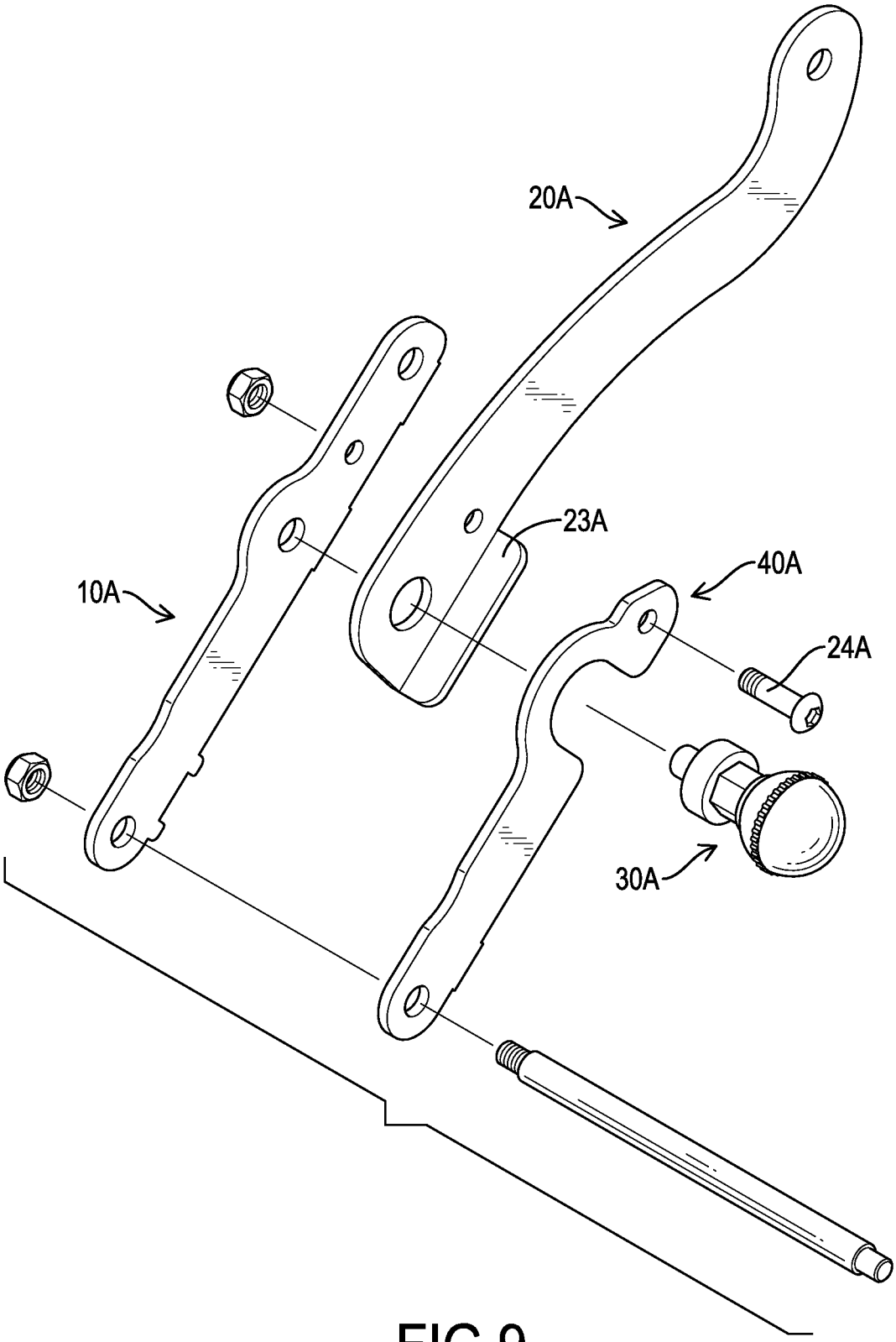
FIG. 9 is an exploded perspective view of the foldable frame construction in FIG. 8.
Figure 10:
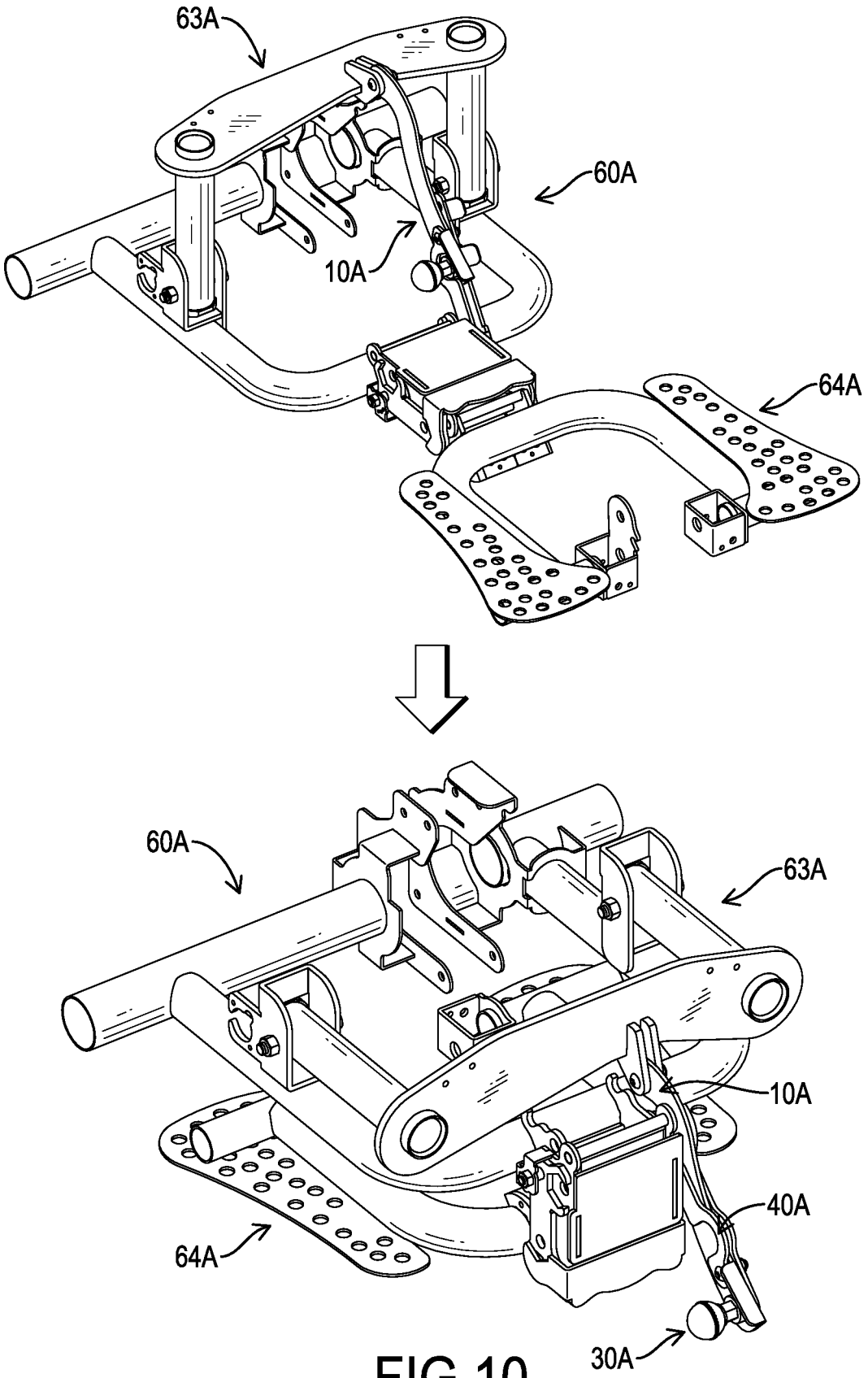
FIG. 10 shows operational perspective views of the foldable frame construction in FIG. 8, mounted with an assistive device under a folded condition.

With reference to FIGS. 8 and 9, a second embodiment of a foldable frame construction for mobility aids in accordance with the present invention has a mounting frame 10A, a pivotal arm 20A, an operating element 30A, and a reinforcing rib 40A. The second embodiment of the foldable frame construction is substantially the same as the first embodiment except for the following features. The shapes and lengths of the second embodiment of the foldable frame construction are different from those of the first embodiment of the foldable frame construction. With reference to FIG. 10, the mounting frame 10A is connected to a foot frame 64A of an assistive device 60A, and the pivotal arm 20A is connected to a bottom frame 63A of the assistive device 60A. Furthermore, the flange 23A is formed on and protrudes transversally from the pressing end of the pivotal arm 20A and selectively abuts against the pivotal rod 24A. Then, when the pivotal arm 20A is pivoted relative to the mounting frame 10A, the bottom frame 63A and the foot frame 64A of the assistive device 60A can be pivoted with each other to enable the assistive device 60A to set under a folded condition.

According to the above-mentioned features and structural relationships of the foldable frame construction of the present invention, in use, a user only needs to pull the pull button 33 of the operating element 30, 30A, and the engaging bolt 32 can be separated from the through hole 12. Then, the pivotal arm 20, 20A can be pivoted relative to the mounting frame 10, 10A, and the chair frame 61 and the seat 62 of the assistive device 60 or the bottom frame 63A and the foot frame 64A of the assistive device 60A can be operated to fold conveniently. After folding the mobility aids 60, 60A, the engaging bolt 32 is moved into the limiting hole 11, and the pivotal arm 20, 20A cannot pivot relative to the mounting frame 10, 10A. Therefore, the mobility aids 60, 60A can be operated conveniently under the folded condition by the foldable frame construction, and this also can reduce the space for placing the mobility aids 60, 60A, and can facilitate moving or transporting the mobility aids 60, 60A in a small space to improve the practicality of the mobility aids 60, 60A.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable frame construction for mobility aids comprising:

a mounting frame having
- a fixed end;
- a limiting end being opposite to the fixed end of the mounting frame;
- a limiting hole formed through the mounting frame adjacent to the limiting end of the mounting frame;
- a through hole formed through the mounting frame between the fixed end and the limiting hole of the mounting frame;
- two pivot holes formed through the mounting frame at a spaced interval to dispose the through hole between the two pivot holes; and
- a pivot shaft connected to one of the two pivot holes that is disposed between the through hole and the fixed end of the mounting frame;

a pivotal arm rotatably connected to the mounting frame and having
- a pivotal end disposed away from the fixed end of the mounting frame;
- a pressing end being opposite to the pivotal end of the pivotal arm; and
- a positioning hole formed through the pivotal arm and selectively aligning with the through hole of the mounting frame;
- a pivotal hole formed through the pivotal arm adjacent to the positioning hole, and aligning with the pivot hole of the mounting frame that is disposed between the limiting hole and the through hole; and
- a pivotal rod connected to the pivotal hole and the corresponding pivot hole to enable the pivotal arm to pivot relative to the mounting frame; and an operating element connected to the pivotal arm and the mounting frame to limit a position of the pivotal arm relative to the mounting frame, and having
- a fixing ring base securely connected to the pivotal arm around the positioning hole;
- an engaging bolt movably mounted in the fixing ring base and having
  - an inserting end selectively extending into the through hole via the positioning hole; and
  - a connecting end extending out of the fixing ring base and being opposite to the mounting frame; and
- a pull button connected to the connecting end of the engaging bolt;

wherein when the pivotal arm is pivoted relative to the mounting frame to make the positioning hole align with the limiting hole, the engaging bolt is mounted in the positioning hole via the limiting hole;

a reinforcing rib connected to the mounting frame and the pivotal arm, and the reinforcing rib having
- a connecting end connected to the fixed end of the mounting frame to hold the pivotal arm between the mounting frame and the reinforcing rib;
- a linking end being opposite to the connecting end of the reinforcing rib, and pivotally connected to the pivotal arm and the mounting frame;
- a curved segment formed on the reinforcing rib between the connecting end and the linking end of the reinforcing rib and surrounding the fixing ring base; and
- two communicating holes formed through the reinforcing rib respectively at the connecting end and the linking end of the reinforcing rib, the communicating hole that is disposed at the connecting end of the reinforcing rib aligning with the pivot hole that is disposed adjacent to the fixed end of the mounting frame, and the communicating hole that is disposed at the linking end of the reinforcing rib aligning with the pivotal hole of the pivotal arm and the pivot hole of the mounting frame that is disposed adjacent to the limiting hole;

wherein the pivot shaft extends through the communicating hole that is disposed at the connecting end of the reinforcing rib, and is connected to the corresponding pivot hole to connect the reinforcing rib with the mounting frame, and the pivotal rod is connected to the reinforcing rib, the pivotal arm, and the mounting frame via the corresponding communicating hole, the pivotal hole, and the corresponding pivot hole.

2. The foldable frame construction for mobility aids as claimed in claim 1, wherein the pivotal arm has a flange formed on and protruding from the pressing end of the pivotal arm and selectively abutting against the pivot shaft of the mounting frame.

3. The foldable frame construction for mobility aids as claimed in claim 2, wherein the mounting frame has at least one guiding slice aslant formed on and protruding from a side edge of the mounting frame adjacent to the limiting hole or the through hole;

wherein the engaging bolt is moved with the pull button relative to the fixing ring base, the positioning hole and the through hole, is separated from the through hole and abuts against the at least one guiding slice when the pivotal arm is pivoted relative to the mounting frame.

4. The foldable frame construction for mobility aids as claimed in claim 1, wherein the pivotal arm has a flange formed on and protruding transversally from the pressing end of the pivotal arm and selectively abutting against the pivotal rod.

5. The foldable frame construction for mobility aids as claimed in claim 2, wherein the mounting frame has two guiding slices, and one of the two guiding slices is disposed adjacent to the limiting hole, and another one of the two guiding slices is disposed adjacent to the through hole;

wherein the engaging bolt is moved with the pull button relative to the fixing ring base, the positioning hole and the through hole, is separated from the through hole and abuts against the two guiding slices when the pivotal arm is pivoted relative to the mounting frame.

6. The foldable frame construction for mobility aids as claimed in claim 4, wherein the mounting frame has two guiding slices, and one of the two guiding slices is disposed adjacent to the limiting hole, and another one of the two guiding slices is disposed adjacent to the through hole;

wherein the engaging bolt is moved with the pull button relative to the fixing ring base, the positioning hole and the through hole, is separated from the through hole and abuts against the two guiding slices when the pivotal arm is pivoted relative to the mounting frame.

7. The foldable frame construction for mobility aids as claimed in claim 2, wherein the mounting frame has a connecting tab formed on and protruding from the fixed end of the mounting frame.

8. The foldable frame construction for mobility aids as claimed in claim 4, wherein the mounting frame has at least one guiding slice aslant formed on and protruding from a side edge of the mounting frame adjacent to the limiting hole or the through hole;

wherein the engaging bolt is moved with the pull button relative to the fixing ring base, the positioning hole and the through hole, is separated from the through hole and abuts against the at least one guiding slice when the pivotal arm is pivoted relative to the mounting frame.

9. The foldable frame construction for mobility aids as claimed in claim 1, wherein the mounting frame has at least one guiding slice aslant formed on and protruding from a side edge of the mounting frame adjacent to the limiting hole or the through hole;

wherein the engaging bolt is moved with the pull button relative to the fixing ring base, the positioning hole and the through hole, is separated from the through hole and abuts against the at least one guiding slice when the pivotal arm is pivoted relative to the mounting frame.

10. The foldable frame construction for mobility aids as claimed in claim 1, wherein the mounting frame has two guiding slices, and one of the two guiding slices is disposed adjacent to the limiting hole, and another one of the two guiding slices is disposed adjacent to the through hole;

wherein the engaging bolt is moved with the pull button relative to the fixing ring base, the positioning hole and the through hole, is separated from the through hole and abuts against the two guiding slices when the pivotal arm is pivoted relative to the mounting frame.

11. The foldable frame construction for mobility aids as claimed in claim 1, wherein the mounting frame has a connecting tab formed on and protruding from the fixed end of the mounting frame.

* * * * *